US008345909B2

(12) United States Patent
Ickler

(10) Patent No.: US 8,345,909 B2
(45) Date of Patent: Jan. 1, 2013

(54) LOUDSPEAKER ASSEMBLY

(75) Inventor: Christopher B. Ickler, Sudbury, MA (US)

(73) Assignee: Bose Corporation, Framingham, MA (US)

( * ) Notice: Subject to any disclaimer, the term of this patent is extended or adjusted under 35 U.S.C. 154(b) by 1076 days.

(21) Appl. No.: 12/061,996

(22) Filed: Apr. 3, 2008

(65) Prior Publication Data

US 2009/0252363 A1 Oct. 8, 2009

(51) Int. Cl.
*H04R 1/20* (2006.01)

(52) U.S. Cl. ..... 381/338; 381/337; 381/341; 381/351

(58) Field of Classification Search ..... 381/337, 381/338, 351, 161, 382, 340–342, 335, 348, 381/205, 89; 181/156, 145, 148, 152, 199, 181/153
See application file for complete search history.

(56) References Cited

U.S. PATENT DOCUMENTS

| | | | | |
|---|---|---|---|---|
| 1,170,800 | A | 2/1916 | Cheney | |
| 4,164,988 | A * | 8/1979 | Virva | 181/156 |
| 4,628,528 | A | 12/1986 | Bose et al. | |
| 4,655,315 | A | 4/1987 | Saville | |
| 5,082,084 | A * | 1/1992 | Ye-Ming | 181/153 |
| 5,450,495 | A * | 9/1995 | Goldfarb | 381/89 |
| 5,550,926 | A * | 8/1996 | Tsao | 381/386 |
| 5,644,109 | A * | 7/1997 | Newman | 181/156 |
| 5,734,728 | A | 3/1998 | Meisnner | |
| 5,889,875 | A * | 3/1999 | Caron et al. | 381/338 |
| 6,079,515 | A * | 6/2000 | Newman | 181/156 |
| 6,176,346 | B1 * | 1/2001 | Wiener | 181/199 |
| 6,278,789 | B1 * | 8/2001 | Potter | 381/338 |
| 2005/0163334 | A1 | 7/2005 | Suprapmo et al. | |
| 2007/0017834 | A1 | 1/2007 | Chang et al. | |

FOREIGN PATENT DOCUMENTS

| | | | |
|---|---|---|---|
| DE | 3347158 | A1 | 7/1985 |
| GB | 2245798 | A | 1/1992 |
| JP | 56000795 | A | 1/1981 |
| JP | 7284182 | A | 10/1995 |
| SU | 623271 | A1 | 7/1978 |
| WO | 98/16085 | | 4/1998 |
| WO | 9816085 | A1 | 4/1998 |
| WO | 2005104608 | | 11/2005 |
| WO | 2007006304 | A1 | 1/2007 |

OTHER PUBLICATIONS

International Search Report and Written Opinion dated Jul. 17, 2009 for PCT/US2009/036298.
International Preliminary Report on Patentability dated Oct. 14, 2010 for PCT/US2009/036298.
EP Exam Report dated Mar. 4, 2011 for EP Appln. No. 09728752.8.
Summons to Attend Oral Proceedings dated Mar. 3, 2012 for EP application No. 09728752.8.

* cited by examiner

*Primary Examiner* — Mohamad Musleh
*Assistant Examiner* — Mangtin Lian

(57) ABSTRACT

A loudspeaker assembly comprises a base supporting at least one electro-acoustic transducer and at least one waveguide segment detachably supported by the base.

11 Claims, 7 Drawing Sheets

LOUDSPEAKER ASSEMBLY

BACKGROUND

This disclosure describes a loudspeaker assembly.

A conventional loudspeaker system generally comprises an enclosure supporting at least one electro-acoustic transducer. One type of loudspeaker system incorporates at least one waveguide to take advantage of a waveguide's favorable properties, for example see U.S. Pat. No. 4,628,528, hereby incorporated by reference. Conventional loudspeaker systems, especially those designed to produce low frequencies, are often large, heavy and cumbersome thereby making transport of such systems difficult.

SUMMARY

A loudspeaker assembly comprises a base supporting at least one electro-acoustic transducer and at least one waveguide segment detachably supported by the base.

One embodiment of the present invention is directed to a loudspeaker comprising: a base housing at least one electro-acoustic transducer; and a waveguide, the waveguide including a first waveguide segment configured to be seated on and acoustically coupled to the base in a first configuration and configured to nest around the base in a second configuration. In an aspect, the first waveguide segment further comprises a wall having a necked region at one end of the wall, the necked region configured to provide an interference fit with the base in the first configuration. In another aspect, the first waveguide segment further comprises a wall having a flange at one end of the wall, the flange configured to seat the first waveguide segment in at least one of the first and the second configurations. In another aspect, a second waveguide segment is configured to be seated on and acoustically couple to the first waveguide segment in the first configuration and configured to nest around the first waveguide segment in the second configuration. In an aspect, at least one amplifier is electrically coupled to the at least one electro-acoustic transducer. In another aspect, the first waveguide segment has a circular cross-section. In another aspect, the at least one electro-acoustic transducer comprises at least a first electro-acoustic transducer and a second electro-acoustic transducer, wherein a first side of the first electro-acoustic transducer is orientated towards a first side of the second electro-acoustic transducer. In another aspect, the waveguide has an effective length equal to a quarter wavelength of a frequency between approximately 35 to 55 Hertz. In another aspect, the waveguide has an effective length equal to a quarter wavelength of a frequency of approximately 16-32 Hertz. In another aspect, the waveguide has an effective length equal to a quarter wavelength of a frequency between approximately 65 to 90 Hertz. In another aspect, each electro-acoustic transducer further comprises a first side and a second side, the first side directly acoustically coupled to a listening volume and the second side acoustically coupled to the listening volume through the waveguide. In one aspect, the first waveguide segment is held in place seated to the base by a force of gravity.

Another embodiment of the present invention is directed to a loudspeaker comprising: a base supporting at least one electro-acoustic transducer; and a first waveguide segment having a flange, the first waveguide segment configured to be seated on and acoustically coupled to the base in a first configuration and configured to nest around the base in a second configuration. In an aspect, a second waveguide segment having a second flange, the second waveguide segment configured to be seated on and acoustically couple to the first waveguide segment in the first configuration and configured to nest around the first waveguide segment in the second configuration. In one aspect, the first waveguide segment is held in place seated to the base by a force of gravity.

Another embodiment of the present invention is directed to a method of packing a loudspeaker comprising: providing a base housing at least one electro-acoustic transducer and a first waveguide segment configured to be seated on and acoustically coupled to the base; lifting the first waveguide segment; inverting the first waveguide segment; and sliding the first waveguide segment over an exterior surface of the base. In an aspect, the method further comprises: providing a second waveguide segment configured to be seated on and acoustically couple to the first waveguide segment; lifting the second waveguide segment; inverting the second waveguide segment; and sliding the second waveguide segment over an exterior surface of the first waveguide segment.

DETAILED DESCRIPTION

Figure 1A:
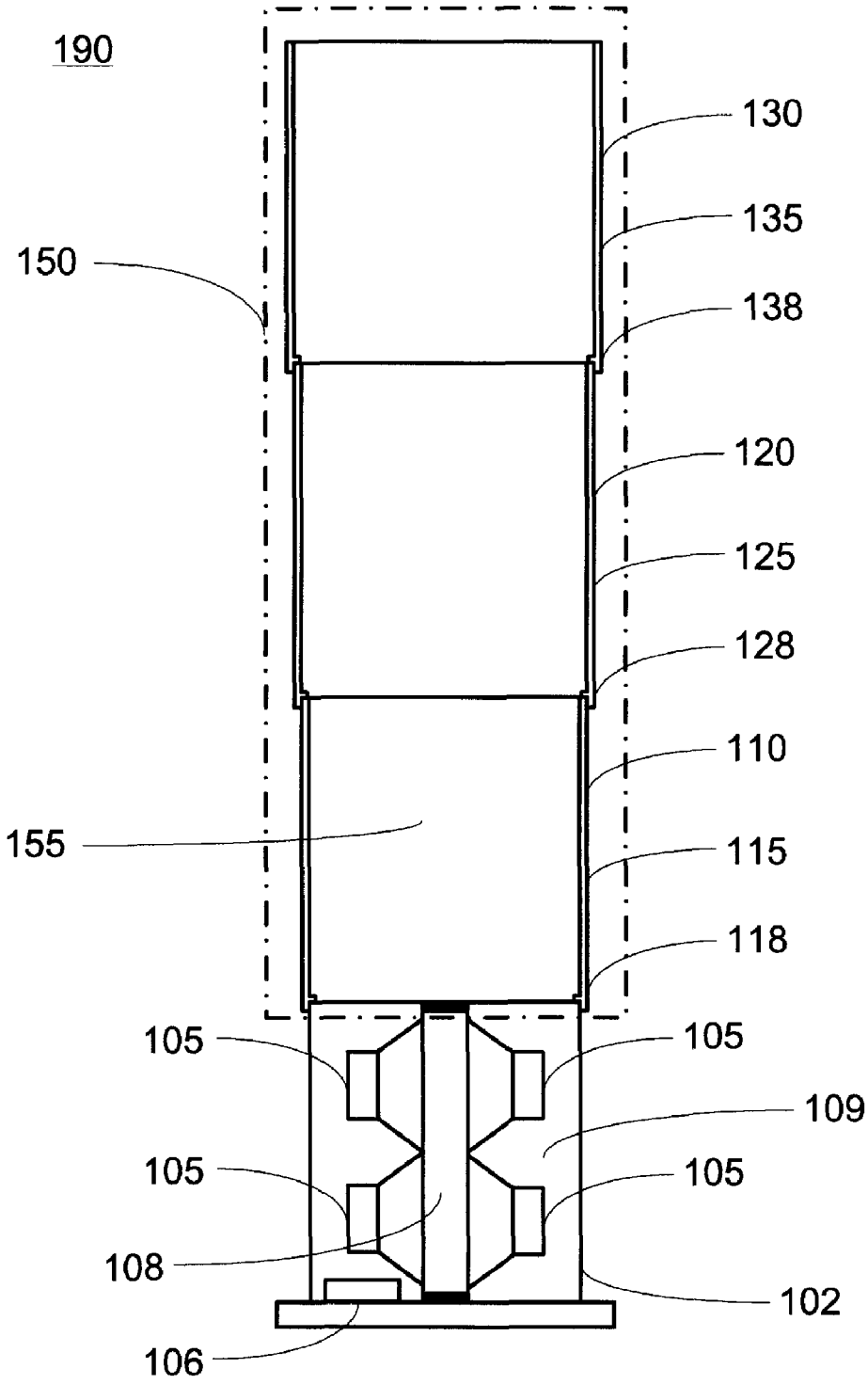
FIG. 1A is a side sectional view of a loudspeaker in a first configuration.

FIG. 1A illustrates a side sectional view of a loudspeaker. A base 102 is acoustically coupled to a waveguide 150 in a first, or extended, configuration. The base 102 houses at least one electro-acoustic transducer 105. Each electro-acoustic transducer 105 has a first side acoustically coupled to a front volume 108, where the front volume is directly acoustically coupled to a listening volume 190. A second side of each electro-acoustic transducer 105 is acoustically coupled to a back volume 109. The base 102 may include at least one amplifier 106 to drive the at least one electro-acoustic transducer 105.

Multiple electro-acoustic transducers 105 may be used to reduce the size and mass of the base 102. For example, four electro-acoustic transducers 105, each having a radius R, may be arranged on either side of the front volume 108 in a compact configuration to replace a single larger electro-acoustic transducer having a radius 2R, while maintaining a constant driving area $4\pi R^2$. Additionally, this arrangement may reduce mechanical vibrations in the base 102 by using forces produced by the electro-acoustic transducers 105 on one side of the front volume 108 to counterbalance the opposite forces produced by the electro-acoustic transducers 105 on the other side of the front volume 108.

The waveguide 150 includes one or more waveguide segments 110, 120 and 130 that may be stacked on top of each other to define a waveguide volume 155. The waveguide 150 is detachably supported by the base 102. The waveguide volume 155 acoustically couples the back volume 109 to the listening volume 190. Each waveguide segment 110, 120 and 130 has a wall 115, 125 and 135 capped by a flange 118,128 and 138. Each flange is sized to be seated on the waveguide segment or base below the flange's waveguide segment, such that each waveguide segment is held in the extended configuration. The weight of the waveguide segment, i.e. the force of gravity on the waveguide segment, is sufficient to keep the waveguide segment positioned in the waveguide, preferably without the use of fasteners or couplings, as the force generated by air friction on the waveguide segments is substantially less that the weight of the waveguide segment.

The waveguide 150 is a resonant structure having a resonant frequency determined by its effective length. The effective length of the waveguide may be selected according to the desired use of the loudspeaker. For example, the length of the waveguide 150 may be selected such that the effective length is equal to about one-fourth, or a quarter of, the wavelength of a desired low frequency reproduction at approximately full level through the loudspeaker system. In an application for musicians, it may be desirable to have a low frequency reproduction extend to a frequency of between approximately 35 to 55 Hertz, depending of the characteristics of an instrument or instruments played through the loudspeaker. In another application, such as for example tubas, large pipe organs, or special effects media having explosions and crashes, the length of the waveguide may be selected to have a low frequency reproduction extended to a frequency of approximately 16-32 Hertz. In another application, the length of the waveguide may be selected to have a low frequency reproduction extended to a frequency range between approximately 65 to 90 Hertz.

Figure 1B:
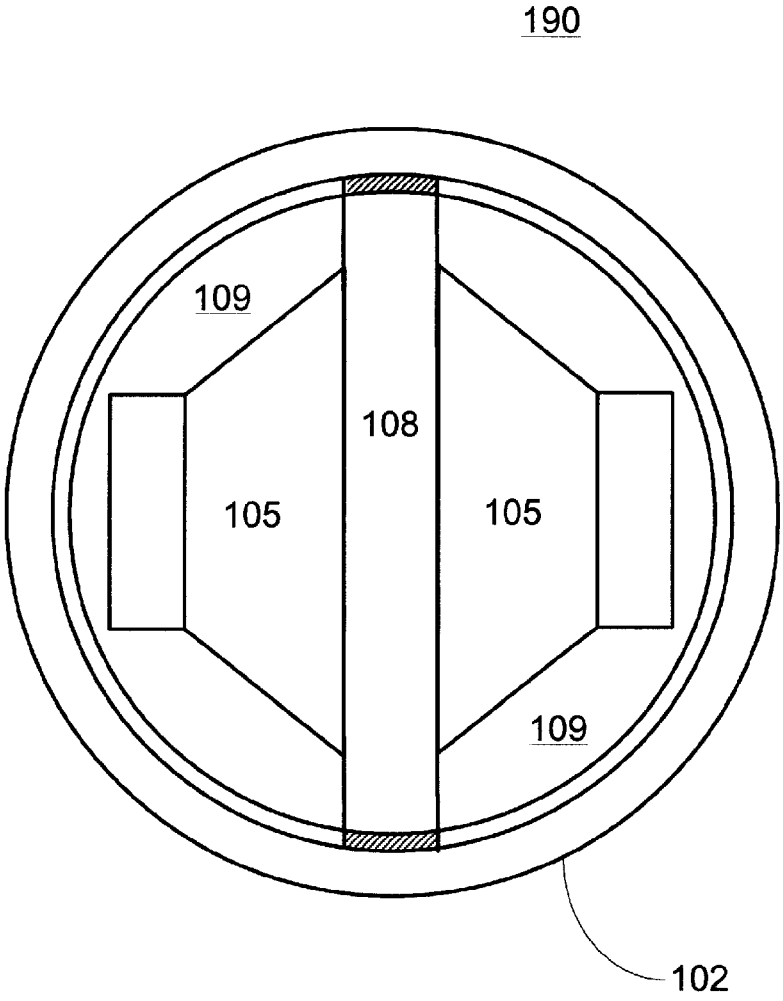
FIG. 1B is a top sectional view of a base of the loudspeaker in FIG. 1A.

FIG. 1B illustrates a top sectional view of the base 102 of the loudspeaker in FIG. 1A. In the example illustrated in FIG. 1B, the base and each waveguide segment have a circular cross-section. The circular cross-section provides structural rigidity, thereby allowing for thinner waveguide segment walls and reduced weight. The loudspeaker may be constructed from any suitable material that provides enough structural rigidity to prevent the waveguide 150 from collapsing during the loudspeaker's operation. For example, cardboard tubes such as Sonotubes have been used as a waveguide segment wall material. Thin tubes constructed of metal, plastic, fiberglass or other similar materials may also be suitable in some applications.

Figure 1C:
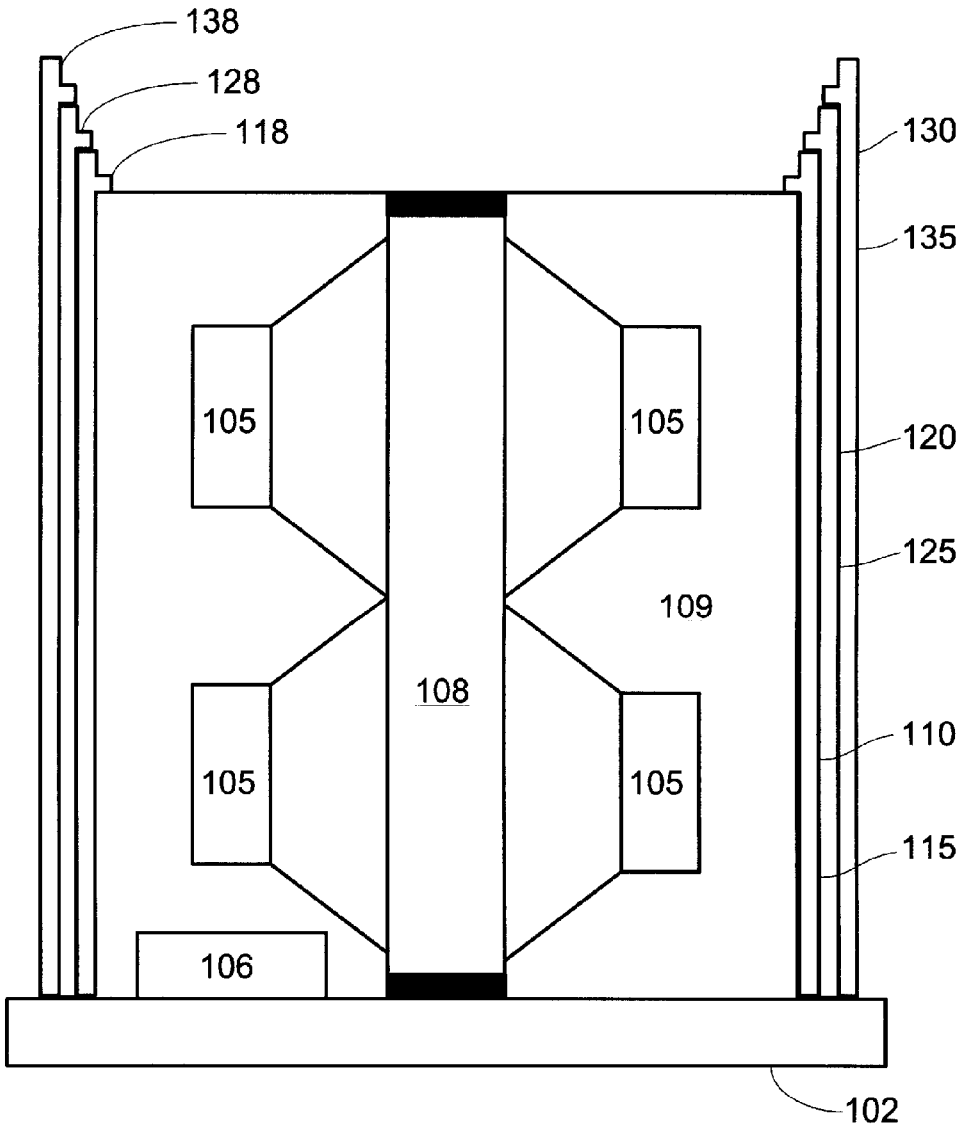
FIG. 1C is a side sectional view of the loudspeaker in FIG. 1A in a second configuration.

FIG. 1C illustrates a side sectional view of the loudspeaker in FIG. 1A in a second, or collapsed, configuration. In the collapsed configuration, the wall inner diameter of each waveguide segment is sized to nest over, thereby containing within it, an exterior surface of the base or another waveguide segment. For example, in FIG. 1C, the first waveguide segment 110 is nested over an exterior surface of the base 102. The second waveguide segment 120 is nested over an exterior surface of the first waveguide segment 110. Similarly, the third waveguide segment 130 is nested over the surface of the second waveguide segment 120. Each flange 118, 128 and 138 may support and/or seat each waveguide segment in the collapsed configuration. In the collapsed configuration the loudspeaker is more compact and portable, allowing the entire loudspeaker to be lifted and carried, making transportation less difficult.

The loudspeaker may be collapsed from the extended configuration in FIG. 1A to the collapsed configuration in FIG. 1C. Each waveguide segment may be lifted off the base or another waveguide segment, inverted and slid over the exterior surface of the base or another waveguide segment to nest in the collapsed configuration. For example, the third waveguide segment 130 may be lifted off the second waveguide segment 120. The second waveguide segment 120 may be lifted off the first waveguide segment 110. The first waveguide segment 110 may be lifted off the base 102. Each of the waveguide segments may be inverted. The first waveguide segment 110 may be slid over the exterior surface of the base 102 to nest. The second waveguide segment 120 may be slid over the exterior surface of the first waveguide segment 110 to nest. And the third waveguide segment 130 may be slid over the exterior surface of the second waveguide segment 120 to nest.

Figure 2A:
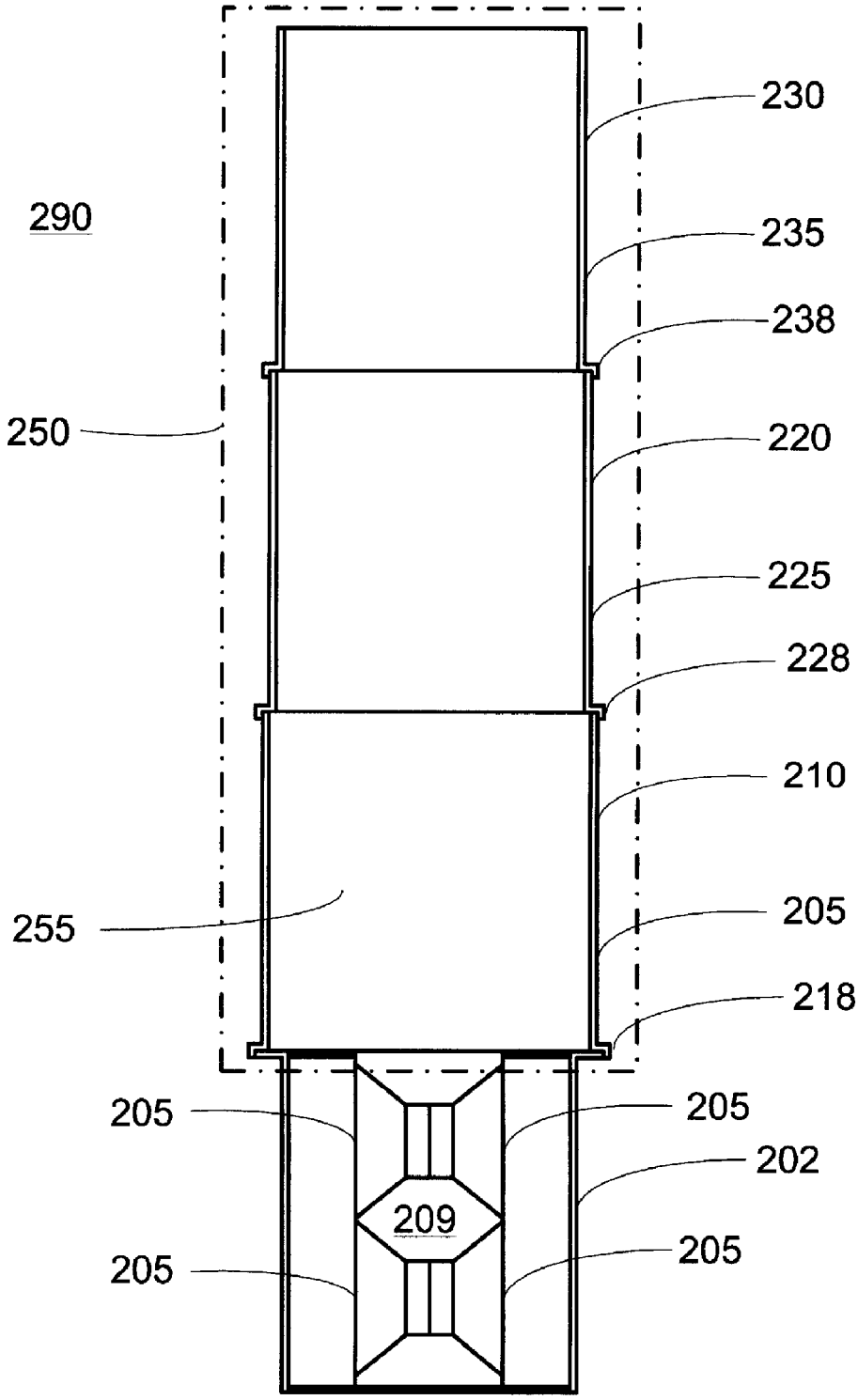
FIG. 2A is a side sectional view of another example of a loudspeaker in a first configuration.

FIG. 2A illustrates a side sectional view of another example of a loudspeaker in the first, or extended, configuration. A base 202 is acoustically coupled to a waveguide 250. The base 202 houses at least one electro-acoustic transducer 205. Each electro-acoustic transducer 205 has a first side directly acoustically coupled to listening volume 290. The second side of each electro-acoustic transducer is acoustically coupled to a back volume 209.

The waveguide 250 includes one or more waveguide segments 210, 220 and 230 that may be stacked on top of each other to define a waveguide volume 255, the waveguide 250 detachably supported by the base 202. The waveguide volume 255 acoustically couples the back volume 209 to the listening volume 290. Each waveguide segment 210, 220 and 230 has a wall 215, 225 and 235 capped by a flange 218, 228 and 238. Each flange is sized to be seated on the waveguide segment or base below.

Figure 2B:
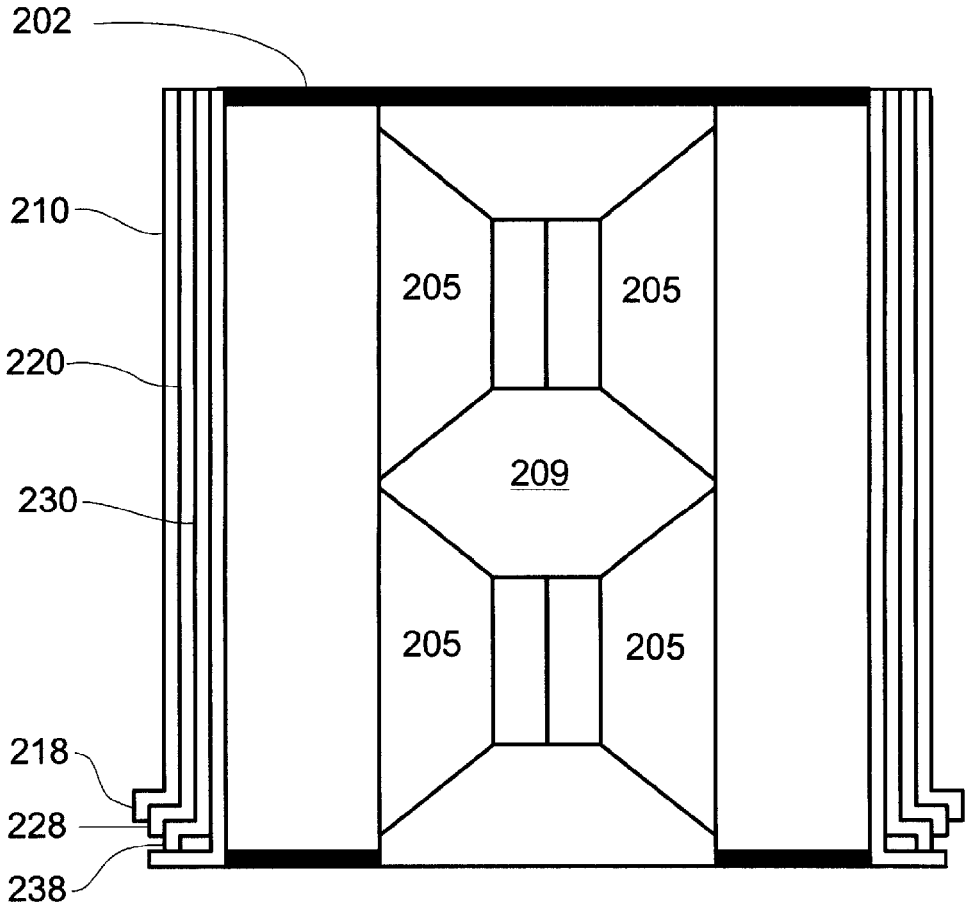
FIG. 2B is a side sectional view of the loudspeaker in FIG. 2A in a second configuration.

FIG. 2B illustrates a side sectional view of the loudspeaker in FIG. 2A in the second, or collapsed, configuration. In the collapsed configuration, each waveguide segment is nested over the base or another waveguide segment. The wall of each waveguide segment is sized to nest over an exterior surface of the base or another waveguide segment. For example, in FIG. 2B, the third waveguide segment 230 nests over the exterior surface of the base 202. The second waveguide segment 220 nests over the exterior surface of the third waveguide segment 230. And the first waveguide segment 210 nests over the exterior surface of the second waveguide segment 220. The base may support each waveguide segment in the collapsed configuration.

The loudspeaker may be collapsed from the extended configuration in FIG. 2A to the collapsed configuration in FIG. 2B. Each waveguide segment may be lifted off the base or another waveguide segment. The base may be inverted. And each waveguide segment may be slid over the exterior surface of the base or another waveguide segment to nest in the collapsed configuration. For example, the third waveguide segment 230 may be lifted off the second waveguide segment 220. The second waveguide segment 220 may be lifted off the first waveguide segment 210 and slid over the exterior surface of the third waveguide segment 230 to nest. The first waveguide segment 210 may be lifted off the base 202 and slid over the second waveguide segment 220 to nest. The base 202 may be inverted. And the third waveguide segment 230, along with the nested second and third waveguide segments, may be slid over the exterior surface of the base 202 to nest in the collapsed configuration.

Figure 3A:
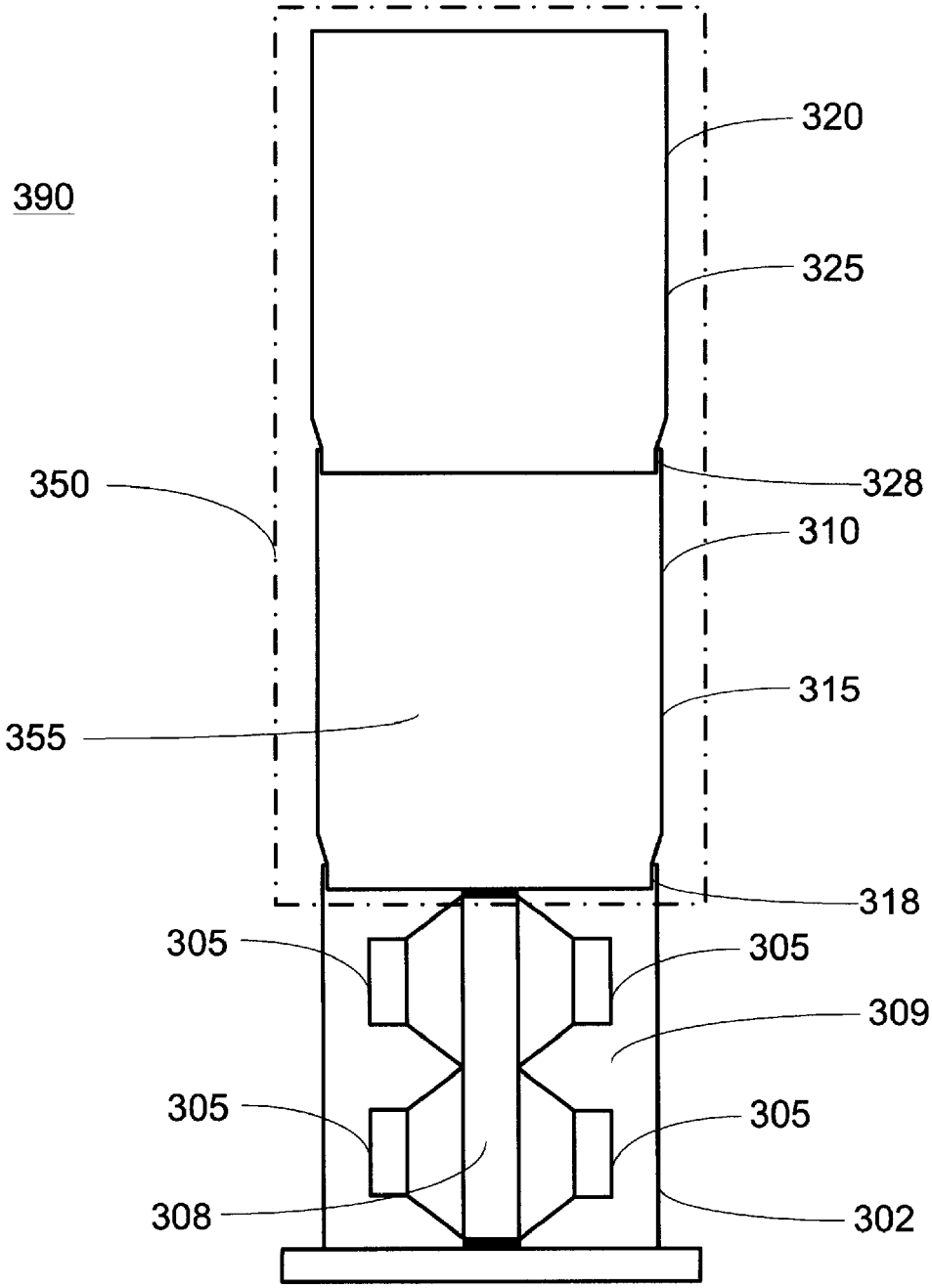
FIG. 3A is a side sectional view of another example of a loudspeaker in a first configuration.

FIG. 3A illustrates a side sectional view of another example of a loudspeaker in the first, or extended, configuration. A base 302 is acoustically coupled to a waveguide 350. The base 302 houses at least one electro-acoustic transducer 305. Each electro-acoustic transducer 305 has a first side acoustically coupled to a front volume 308, where the front volume is directly acoustically coupled to a listening volume 390. A second side of each electro-acoustic transducer 305 is acoustically coupled to a back volume 309.

The waveguide 350 includes one or more waveguide segments 310 and 320 that may be stacked on top of each other to define a waveguide volume 355. The waveguide 350 is detachably supported by the base 302. The waveguide volume 355 acoustically couples the back volume 309 to the listening volume 390. Each waveguide segment 310 and 320 has a wall 315 and 325 capped by a necked region 318 and 328. Each necked region is sized to fit within the waveguide segment or base below. The fit may be an interference fit providing a frictional force between the necked region and the waveguide segment or base below to secure each waveguide segment in the extended configuration.

Figure 3B:
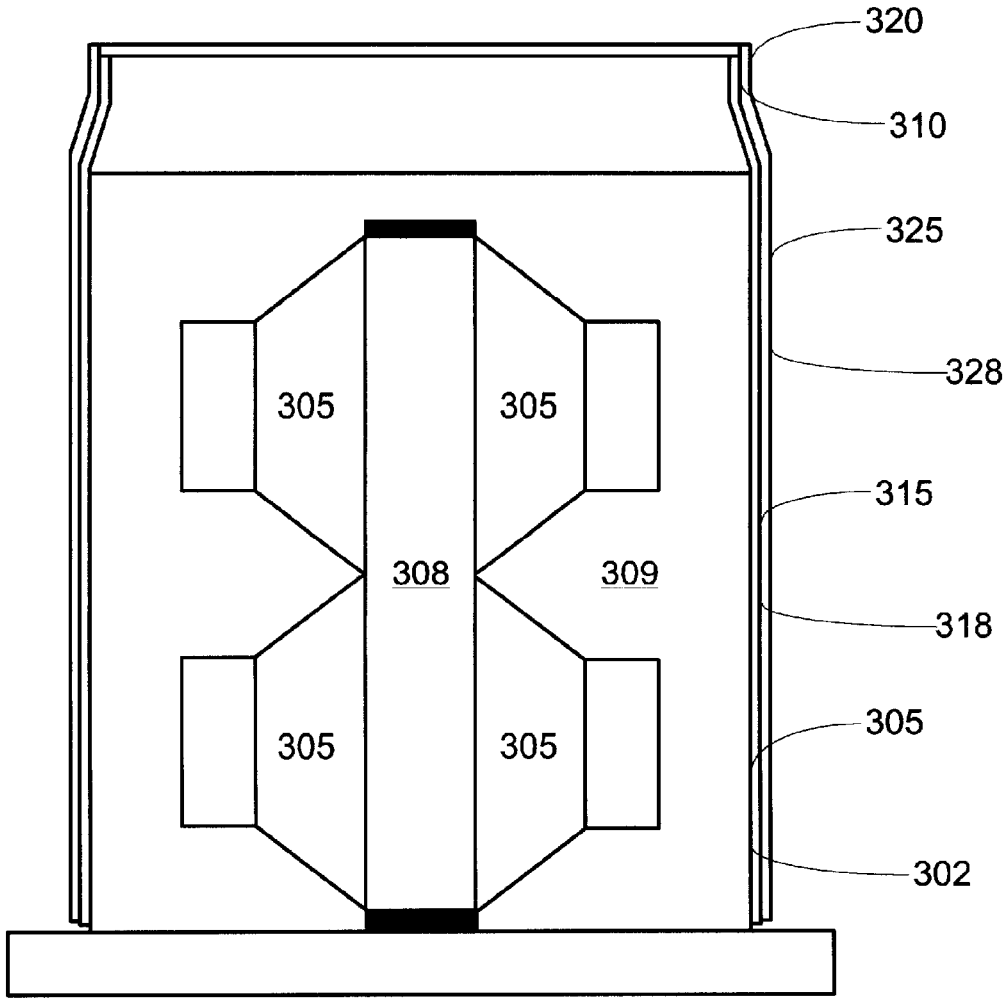
FIG. 3B is a side sectional view of the loudspeaker in FIG. 3A in a second configuration.

The loudspeaker may be collapsed from the extended configuration in FIG. 3A to the collapsed configuration in FIG. 3B. Each waveguide segment may be lifted off the base or another waveguide segment, inverted and slid over the exterior surface of the base or another waveguide segment to nest in the collapsed configuration. For example, the second waveguide segment 320 may be lifted off and out of the first waveguide segment 310. The first waveguide segment may be lifted off and out of the base 302. Each waveguide segment may be inverted. The first waveguide segment 310 may be slid over the exterior surface of the base 102 to nest. And the second waveguide segment 320 may be slid over the exterior surface of the first waveguide segment 310 to nest.

Having thus described at least illustrative embodiments of the invention, various modifications and improvements will readily occur to those skilled in the art and are intended to be within the scope of the invention. For example, although the examples shown in the figures show three waveguide segments, the teaching described may be applied to any segmented waveguide having one or more waveguide segments and are understood to be within the scope of the present invention. Accordingly, the foregoing description is by way of example only and is not intended as limiting. The invention is limited only as defined in the following claims and the equivalents thereto.

What is claimed:

1. A loudspeaker comprising:

a base housing at least one electro-acoustic transducer; and a waveguide, the waveguide including a first waveguide segment configured to be seated on and acoustically coupled to the base in a first configuration and configured to be nested over an exterior surface of the base in a second configuration; and a second waveguide segment configured to be seated on and acoustically couple to the first waveguide segment in the first configuration and configured to nest around the first waveguide segment in the second configuration.

2. The loudspeaker of claim 1, wherein the first waveguide segment further comprises a wall having a necked region at one end of the wall, the necked region configured to provide an interference fit with the base in the first configuration.

3. The loudspeaker of claim 1, wherein the first waveguide segment further comprises a wall having a flange at one end of the wall, the flange configured to seat the first waveguide segment in at least one of the first and the second configurations.

4. The loudspeaker of claim 1, further comprising at least one amplifier electrically coupled to the at least one electro-acoustic transducer.

5. The loudspeaker of claim 1, wherein the first waveguide segment has a circular cross-section.

6. The loudspeaker of claim 1, wherein the at least one electro-acoustic transducer comprises at least a first electro-acoustic transducer and a second electro-acoustic transducer, wherein a first side of the first electro-acoustic transducer is orientated towards a first side of the second electro-acoustic transducer.

7. The loudspeaker of claim 1, wherein the waveguide has an effective length equal to a quarter wavelength of a frequency between approximately 35 to 55 Hertz.

8. The loudspeaker of claim 1, wherein the waveguide has an effective length equal to a quarter wavelength of a frequency of approximately 16-32 Hertz.

9. The loudspeaker of claim 1, wherein the waveguide has an effective length equal to a quarter wavelength of a frequency between approximately 65 to 90 Hertz.

10. The loudspeaker of claim 1, wherein each electro-acoustic transducer further comprises a first side and a second side, the first side directly acoustically coupled to a listening volume and the second side acoustically coupled to the listening volume through the waveguide.

11. A loudspeaker comprising:

a base supporting at least one electro-acoustic transducer;

a first waveguide segment having a flange, the first waveguide segment configured to be seated on and acoustically coupled to the base in a first configuration and configured to be nested over an exterior surface of the base in a second configuration; and a second waveguide segment having a second flange, the second waveguide segment configured to be seated on and acoustically couple to the first wavequide segment in the first configuration and configured to nest around the first waveguide segment in the second configuration.

* * * * *